US011732857B2

(12) United States Patent
Mitterlehner et al.

(10) Patent No.: US 11,732,857 B2
(45) Date of Patent: Aug. 22, 2023

(54) ILLUMINATION DEVICE OF A MOTOR VEHICLE HEADLAMP HAVING A PROJECTION OPTICS SYSTEM GUIDED ALONG OPTICAL AXIS DIRECTION

(71) Applicant: ZKW Group GmbH, Wieselburg (AT)

(72) Inventors: Stefan Mitterlehner, Mank (AT); Günter Karlinger, Bergland (AT)

(73) Assignee: ZKW Group GmbH, Wieselburg (AT)

( * ) Notice: Subject to any disclaimer, the term of this patent is extended or adjusted under 35 U.S.C. 154(b) by 8 days.

(21) Appl. No.: 17/617,435

(22) PCT Filed: Jun. 8, 2020

(86) PCT No.: PCT/EP2020/065794
§ 371 (c)(1),
(2) Date: Dec. 9, 2021

(87) PCT Pub. No.: WO2020/259994
PCT Pub. Date: Dec. 30, 2020

(65) Prior Publication Data

US 2022/0221122 A1 Jul. 14, 2022

(30) Foreign Application Priority Data

Jun. 27, 2019 (EP) ..... 19182837

(51) Int. Cl.
*F21S 41/29* (2018.01)
*F21S 41/265* (2018.01)
(Continued)

(52) U.S. Cl.
CPC ..... *F21S 41/295* (2018.01); *F21S 41/265* (2018.01); *F21S 43/145* (2018.01); *F21Y 2105/10* (2016.08)

(58) Field of Classification Search
CPC combination set(s) only.
See application file for complete search history.

(56) References Cited

U.S. PATENT DOCUMENTS 10,041,644 B2 * 8/2018 Honda ..... F21S 41/255
2015/0377439 A1 12/2015 Madelaine et al.
(Continued)

FOREIGN PATENT DOCUMENTS

DE 202011108359 1/2012
DE 102010054922 A1 6/2012
(Continued)

OTHER PUBLICATIONS

Machine Transklation of DE 202011011108359 (Year: 2011).*
(Continued)

*Primary Examiner* — Robert J May
(74) *Attorney, Agent, or Firm* — Eversheds Sutherland (US) LLP

(57) ABSTRACT

Lighting device of a motor vehicle headlamp comprising a projection optics system (1) and a light source unit (2), wherein the light source unit comprises a surface (20), wherein the light source unit (2) can generate a lighting pattern on the surface (20), wherein the lighting pattern which can be generated on the surface (20) can be projected in front of the lighting device in the form of a light distribution by means of the projection optics system (1), wherein the light source unit (2) comprises a support structure (3), wherein the support structure (3) has an opening (30), wherein the opening (30) is arranged and designed to match the surface (20) and the lighting pattern can be generated at least on one side (201) of the surface (20) facing the projection optics system (1), wherein the projection optics system (1) has guiding elements (10) and the support structure (3) has elongated guides (31) corresponding to the guiding elements (10), wherein the guiding elements (10) are arranged in such a way that they can be guided in the elongated guides (31) along a longitu- (Continued)

dinal direction (X) of the elongated guides (31), wherein the projection optics system (1) rests on the support structure (3) and is movable along the longitudinal direction (X).

19 Claims, 4 Drawing Sheets

(51) Int. Cl.
*F21S 43/145* (2018.01)
*F21Y 105/10* (2016.01)

(56) References Cited

U.S. PATENT DOCUMENTS

| | | | |
|---|---|---|---|
| 2016/0238206 | A1 | 8/2016 | Honda et al. |
| 2016/0347236 | A1 | 12/2016 | Yatsuda et al. |

FOREIGN PATENT DOCUMENTS

| | | | |
|---|---|---|---|
| EP | 2693109 | A2 | 2/2014 |
| KR | 20140107950 | A | 9/2014 |

OTHER PUBLICATIONS

International Search Report for PCT/EP2020/065794, dated Jul. 30, 2020 (14 pages).
Search Report for European Patent Application No. 19182837.5 dated Aug. 9, 2019 (21 pages).

* cited by examiner

ILLUMINATION DEVICE OF A MOTOR VEHICLE HEADLAMP HAVING A PROJECTION OPTICS SYSTEM GUIDED ALONG OPTICAL AXIS DIRECTION

The invention relates to a lighting device of a motor vehicle headlight comprising a projection optics system and a light source unit. The lighting device is preferably a lighting device that functions according to the projection principle. The light source unit comprises a surface preferably perpendicular to an optical axis of the projection optics system, wherein the light source unit can generate a lighting pattern on the surface. Preferably, the size of the surface is essentially the same as the size of the lighting pattern. The lighting pattern that can be generated on the surface can be projected in front of the lighting device by means of the projection optics system in the form of a light distribution, such as, e.g., a low-beam distribution, a ground projection light distribution or a high-beam distribution. The light source unit also comprises a support structure, wherein the support structure has an opening, wherein the opening is arranged and designed to match the surface and the lighting pattern can be generated at least on one side of the surface facing the projection optics system. For example, a distance between the surface (or the lighting pattern) and the opening is smaller, preferably much smaller, than the dimensions of both the opening and the lighting pattern. This means that the surface is arranged to match the opening, for example at or in the opening, such that, when the lighting pattern is generated on the surface, all the light emitted by the lighting pattern generated on the surface passes through the opening (in the direction of the projection optics system).

In addition, the invention relates to a motor vehicle headlight having at least one such lighting device.

In lighting devices known from the prior art, the projection optics systems are either not adjustable at all relative to the light source or only with the help of complex adjusting mechanisms.

The object of the present invention therefore is to create a lighting device for a motor vehicle headlight, which is simple and can be reliably adjusted.

This object is achieved with a lighting device of the aforementioned type according to the invention in that the projection optics system has guiding elements and the support structure has elongated guides corresponding to the guiding elements, wherein the guiding elements are arranged in the elongated guides such that they can be guided along a longitudinal direction of the elongated guides which is preferably parallel to an optical axis of the projection optics system, wherein the projection optics system rests on the support structure such that it can be fastened to the same and—before the projection optics system is fastened to the support structure—can be moved along the longitudinal direction.

Due to the fact that the preferably centred projection optics system rests on the support structure and can be fastened to the support structure (in a desired position), the invention makes use of gravity, wherein the guidability along the longitudinal direction (before attaching) enables a simple and secure positioning of the projection optics system in relation to the surface with the lighting pattern. Errors (lens shape deviations, lens thickness tolerances . . . ) can be at least partially compensated for to achieve the sharpest possible image, which is particularly important for logo projections. The aforementioned desired position is determined by moving the projection optics system relative to the light source unit along the longitudinal direction and simultaneously analysing the generated light distribution, i.e., when the lighting device is put into operation, in terms of its quality, for example in terms of its sharpness.

The projection optics system is also called a lens in the following. Preferably, two elongated guides and guiding elements are provided. The guiding elements can also be elongated, for example. It may be useful if there is exactly one guiding element per elongated guide. The elongated guides can be designed as trough-shaped receiving means/recesses, for example.

Preferably, the surface may be formed by mirror surfaces of mirrors of a micromirror array of a spatial light modulator, e.g., a DMD chip. However, a light-emitting surface of an LED light source can also act as a surface. In addition, the surface may be designed as a light conversion medium or light conversion medium plate, which can convert light from a laser light source, e.g., a laser diode, into essentially white light. The surface is preferably flat or non-curved. It is self-evident that the LED light sources or laser light source are part of the light source unit in the aforementioned cases.

The projection optics system is preferably downstream of the light source unit in the main beam direction (parallel to the longitudinal direction).

In a preferred embodiment, the lighting device may be designed as a light module. This means that the lighting device, in a mounted state, i.e., when the projection optics system is fastened to the support structure, forms an assembly and does not consist of structurally separated elements or subunits, which are distributed in different places in a motor vehicle headlight, for example.

It may be advantageous if the projection optics system comprises a projection optics holder and at least one projection optics, wherein the at least one projection optics is surrounded by the projection optics holder, wherein the guiding elements are arranged on the projection optics holder.

Lens elements (preferably three), such as, e.g., concave, convex, bi-concave, bi-convex, plano-concave or plano-convex lens elements, can be used as projection optics, for example. The lens elements can be made of different materials (materials that each have a different refractive index) and can be positioned at different distances from each other. For example, different lens elements may have different, coordinated refractive indices. In particular, the lens elements may be made of plastics, such as PC (polycarbonate), PMMA (polymethyl methacrylate), or of optical glass, such as of flint or crown glass.

In a preferred embodiment, the guiding elements may be designed integrally with the projection optics holder and in particular form a monolithic structure with the projection optics holder.

It may be expedient if the projection optics holder rests on the support structure, is movable along the longitudinal direction and can be fastened to the support structure (in a desired position).

In a preferred embodiment, it may be advantageous if the projection optics system comprises two or more, preferably three projection optics.

It may be expedient if the projection optics system has an achromatic and/or apochromatic effect or the projection optics are formed and positioned relative to each other in such a way that the projection optics system has an achromatic and/or apochromatic effect.

It may be advantageous if the guiding elements are designed as ridges, wherein the ridges are designed to be trapezoidal in a sectional view arranged transversely to the longitudinal direction.

In addition, it may be advantageous if the ridges protrude downwards.

In a preferred embodiment, it may be advantageous if the elongated guides are designed as trough-shaped recesses or as holes, through-holes and/or slots, for example, wherein the guiding elements are either partially or completely accommodated in the elongated guides, for example.

Furthermore, it may be advantageous if the projection optics system is movable within a range of movement defined by the length of the elongated guides and the projection optics system, preferably the projection optics holder, has a fastening region and the support structure has a counter-region corresponding to the fastening region, wherein the range of movement, fastening region and the counter-region correspond to each other in such a way that the projection optics system, preferably its projection optics holder, can be fastened to the support structure in any position within the range of movement in such a way that the fastening region of the projection optics system is at least partially fastened to the counter-region of the support structure.

In the context of the present invention, the term "range of movement" is understood to mean the length within which the projection optics system is movable in relation to the light source unit along the optical axis (of the projection optics system) when the guiding elements are arranged in the elongated guides.

In addition, it may be advantageous if the range of movement is also defined by the length of the guiding elements (along the longitudinal direction), e.g., the length of the ridges.

Fastening the projection optics system, preferably its projection optics holder, to the support structure may be carried out by screwing, gluing, riveting or welding.

It may be expedient if the fastening region has at least two, preferably three, through-openings and the counter-region has at least two, preferably three, receiving means, wherein each receiving means corresponds to a through-opening, wherein different receiving means correspond to different through-openings, wherein the fastening region can be fastened to the counter-region by means of at least two, preferably three, fastening elements, such as screws, which can be accommodated in the through-openings and in the receiving means.

It may be advantageous if the through-openings are designed as slots extending in the direction of the optical axis, the length of which corresponds to the range of movement.

It may be advantageous if the fastening region is arranged on the outer circumference of the projection optics holder, wherein the through-openings are distributed across the region, such that they offer a better hold of the projection optics system on the support structure.

In a preferred embodiment, the through-openings or the receiving means may be arranged in a triangle.

It may be expedient if the position (or the desired position) is selected depending on a desired image scale or desired image sharpness.

In a particularly preferred embodiment, the projection optics system, preferably the projection optics holder, may have a handling area which is designed on opposite sides of the projection optics system, preferably of the projection optics holder.

The handling area can, for example, in particular enable automated handling or automated gripping of the projection optics system 1. The handling area can, e.g., be detected by an industrial robot, such as an assembly robot performing precise longitudinal adjustments in the axial direction (in the direction of the optical axis), for example, to achieve a predefined image scale or a predefined image sharpness.

Further advantages may arise if the handling area is formed as preferably tab-shaped elements, preferably tabs, protruding laterally from the projection optics system, preferably from the projection optics holder.

In addition, the lateral tab-shaped elements, preferably tabs, may extend from the projection optics holder in a direction which is orthogonal to the optical axis, preferably horizontally.

In addition, it can be advantageous if the elongated guides each have a stop surface at their ends, such that the respective guiding elements can only be moved from a first end to a second end, which is opposite the first end, of the elongated guide.

In a preferred embodiment, it may be advantageous if the support structure has arms, wherein the arms of the support structure protrude in the direction of the projection optics system, wherein the elongated guides are designed in the arms, and the projection optics system preferably has laterally protruding tabs, wherein the guiding elements are arranged on the protruding tabs.

It may be expedient if exactly two arms are provided, which are arranged to the side of the opening.

In addition, it may be useful if the arms protrude from a plane containing the opening and extend parallel to the longitudinal direction.

Special advantages can arise if the arms form a contact surface for the projection optics system.

It may be expedient if exactly one elongated guide is designed in each arm.

In addition, it may be useful if the tabs are arranged on the projection optics holder. Special advantages can arise if the tabs are designed on the projection optics holder, in particular if they form a monolithic structure with the projection optics holder.

In a particularly preferred embodiment, it may be advantageous if the guiding elements are arranged on the tabs, in particular are designed on the tabs. Special advantages can arise if the guiding elements form a monolithic structure with the tabs. Preferably, the guiding elements protrude downwards from the tabs.

Furthermore, all elongated guides may be of the same length.

The invention and other advantages are explained in more detail below on the basis of exemplary embodiments, which are illustrated in the drawings. In these, FIG. 1 shows a light module in a partially assembled state in perspective view;

Figure 1:
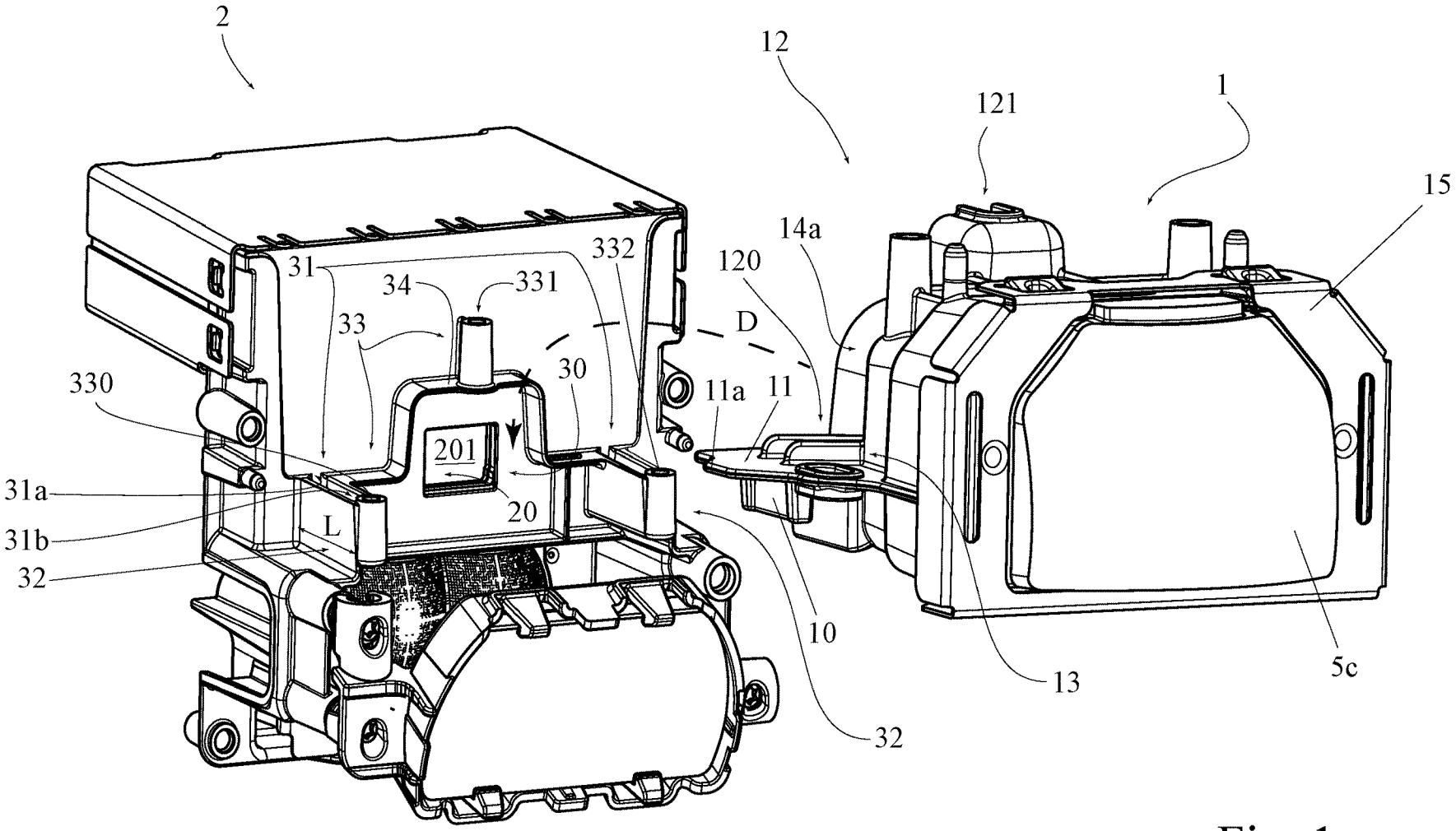

First, reference is made to FIG. 1. It shows a light module for a motor vehicle headlight, which corresponds to a lighting device according to the invention. The light module comprises a projection optics system 1 and a light source unit 2. FIG. 1 shows a partially assembled state of the light module, in which the projection optics system 1 is not fastened to the light source unit 2.

The light source unit comprises a surface 20, which is positioned perpendicular to an optical axis X of the light module. When the light source unit 2 is in operation, it generates a lighting pattern on the surface 20, the size of which pattern is (essentially) the same as the size of the surface 20. FIG. 1 indicates that the lighting pattern is generated on a side 201 of the surface 20 facing the projection optics system 1. The lighting pattern generated on the side 201 is projected in front of the light module by means of the projection optics system 1 in the form of a light distribution, preferably one which complies with relevant law. In the light module shown here, the surface 201 is formed by mirror surfaces of mirrors of a micromirror array of a spatial light modulator, e.g., a DMD chip.

Figure 5:
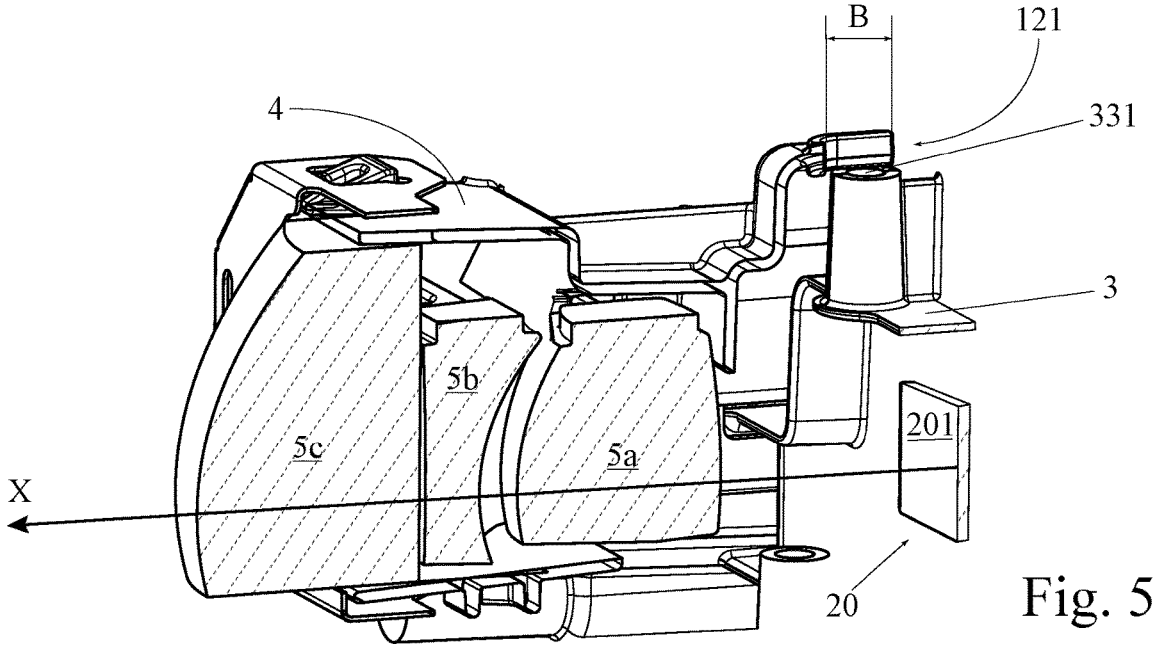
FIG. 5 is a cross-sectional view of the light module from FIG. 2.

The projection optics system 1 comprises a projection optics holder 4, which surrounds three projection optics 5*a*, 5*b*, 5*c*. The projection optics 5*a*, 5*b*, 5*c* are designed as non-rotational symmetrical lens elements (see FIG. 5). The first two lens elements 5*a* and 5*b* (seen from the surface 20) together form a so-called air-spaced achromat (see description of the prior art from DE 10 2010 046 626 84 and in particular paragraphs [0009] to [0013]) and thus correct at least longitudinal chromatic aberrations. However, the air-spaced achromat consisting of lens elements 5*a* and 5*b* can also be designed in such a way that it additionally corrects transverse chromatic aberrations. This can be achieved by optimizing air-spaced achromat parameters, such as lens materials, lens curvatures, gaps between lens elements, and so on. The third lens element 5*c* in this lens-element triplet is a scattering lens and essentially determines the size of the light distribution, especially its height and width.

It should be noted that the projection optics system 1 can also have other elements, such as fastening clips 15 or elastic insert elements (not shown) for clamping the projection optics 5*a*, 5*b*, 5*c* in the projection optics holder 4.

As the image generated on the side 201 of the surface 20 is preferably displayed with a projection optics system 1, preferably a lens element system, the light module works according to the projection principle.

The light source unit 2 also comprises a support structure 3. The support structure 3 has an opening 30, wherein the opening 30 is arranged and designed to match the surface 20. For example, the distance of the lighting pattern from the edges of the opening 30 is smaller, preferably much smaller, than the dimensions of the opening 30 and the lighting pattern itself. This means that the surface 20, or the side 201, is arranged and designed to match the opening 30, for example at or in the opening 30, such that, when the lighting pattern is generated on the surface 20 or on the side 201, essentially all the light emitted by the lighting pattern generated on the surface 20 or on its side 201 passes through the opening 30 (in the direction of the lens or the projection optics system 1). The projection optics system 1 can be designed as a lens.

Furthermore, the projection optics system 1 has two guiding elements 10. The guiding elements 10 according to this preferred embodiment are designed identically. The support structure 3 also has two elongated—also identical—guides 31 corresponding to the guiding elements 10. Each elongated guide 31 corresponds to a guiding element 10, whereby different guides 31 correspond to different guiding elements 10. In the partially assembled state of the light module (see FIGS. 2 to 4), the guiding elements 10 are arranged in the elongated guides 31 in such a manner that they can be guided along a longitudinal direction X of the elongated guides 31. The longitudinal direction X is parallel to the optical axis of the light module or the projection optics system 1. For this reason, the same reference sign "X" is used for the terms "longitudinal direction" and "optical axis". The elongated guides 31 are designed similar to trough-shaped receiving means or recesses (see FIG. 3).

In a mounted state, the projection optics system 1 rests on the support structure 3 and is movable along the longitudinal direction or the optical axis X. This enables a more precise longitudinal adjusting of the projection optics system 1 relative to the support structure 3, whereby a distance between the projection optics system 1 and the side 201 of the DMD chip can be varied, for example, to adjust the image scale. That is, in a position which corresponds to a professional installation position of the lighting device, e.g., the light module, in a motor vehicle headlight, the lens (the projection optics system) rests on the support structure under the influence of gravity. The direction of gravity corresponds to the direction "downwards".

In order to mount the projection optics system 1 on the light source unit 2, the projection optics system 1 is placed on the support structure 3 of the light source unit 2 (see arrow D in FIG. 1), such that the guiding elements 10 are accommodated in the elongated guides 31. Then, the projection optics system 1 is moved back and forth along the longitudinal direction X until an optimal position/location with regard to the surface 20 is achieved (for example in terms of sharpness and scale). Subsequently, the projection optics system 1 is fastened to the support structure, e.g., by screwing, gluing, or welding.

The guiding elements 10 are arranged on the projection optics holder 4. The projection optics holder 4 is designed as a single piece. The projection optics holder 4 may, for example, be made of magnesium diecast, or by thixomoulding or thixoforming, or be designed as a plastic injection-moulded part. The guiding elements 10 of the light module shown here are thus designed integrally with the projection optics holder 4 and form a monolithic structure with the projection optics holder. Thus, the projection optics holder 4 of the lens 1 rests on the support structure 3, is movable along the longitudinal direction X and can be fastened to the support structure 3.

Figure 2:
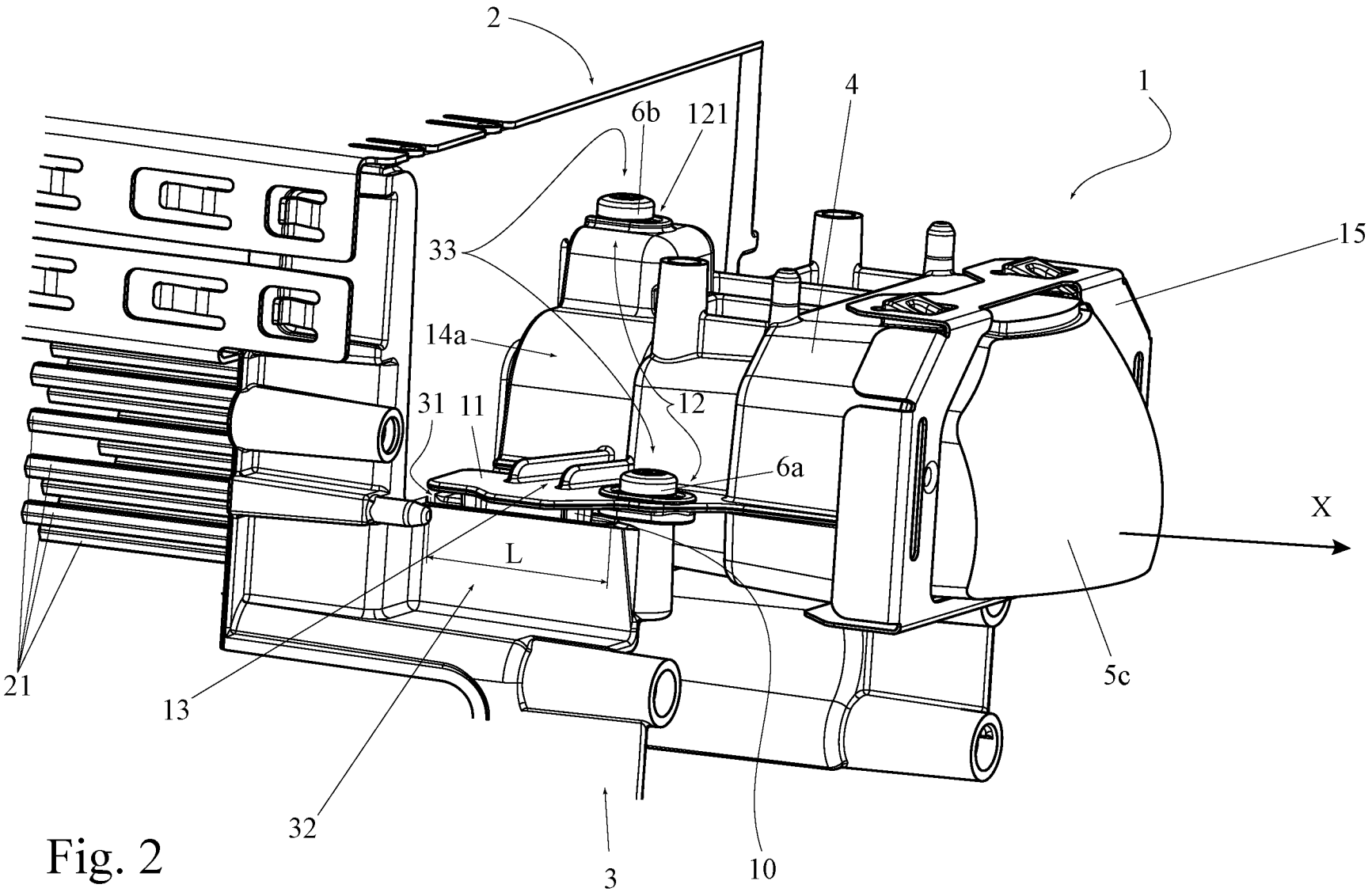
FIG. 2 shows the light module from FIG. 1 in a mounted state.

It should be noted at this point that the light source unit 2 may have other components, which are not discussed further here. For example, FIG. 2 shows cooling fins 21 of a heat sink, which is not shown in more detail, for cooling the light source unit 2. The cooling fins are exemplarily designed in the form of pins arranged parallel to the longitudinal direction X of the elongated guides.

Figure 3:
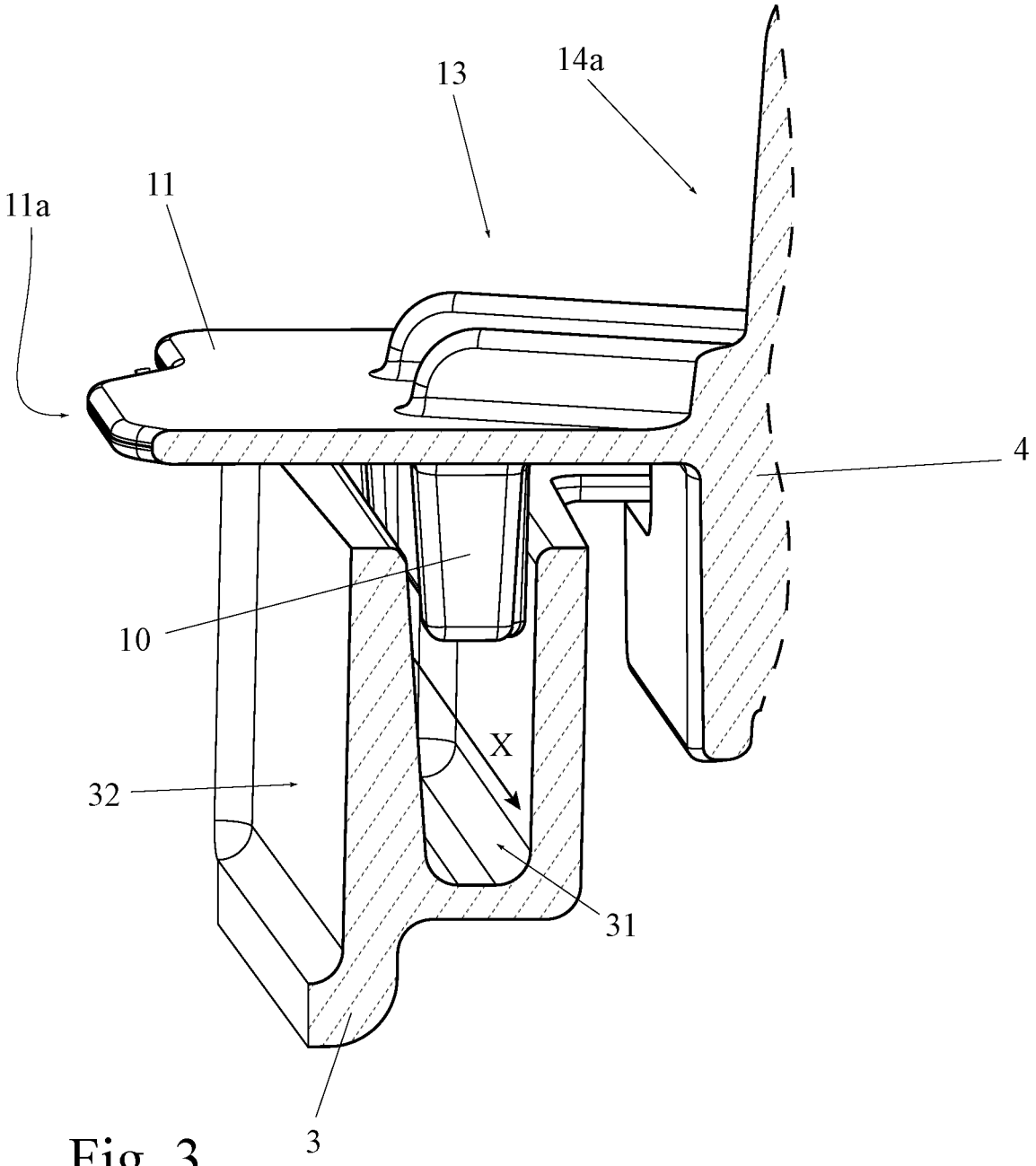
FIG. 3 is a cross-sectional view of an enlarged section of a support structure and a projection optics holder of the light module from FIG. 2.

FIGS. 1 and 3 indicate that the guiding elements are designed as ridges 10 protruding downwards from the projection optics holder 4. The ridges extend in the longitudinal direction X of the elongated guides 31 and have a trapezoidal cross-section. The elongated guides 31 also have a corresponding trapezoidal cross-section. This is particularly evident in FIG. 3.

Due to the fact that the guiding elements 10 are arranged or accommodated in the elongated guides 31, the projection optics system 1 is displaceable relative to the light source unit 2 along the longitudinal direction X of the elongated guides, which extends parallel to the optical axis 31, in particular displaceable back and forth. The length L of the elongated guides 31, and optionally also a length of the ridges 10, define a range of movement B, within which the projection optics system 1 is movable relative to the light source unit 2.

Figure 4:
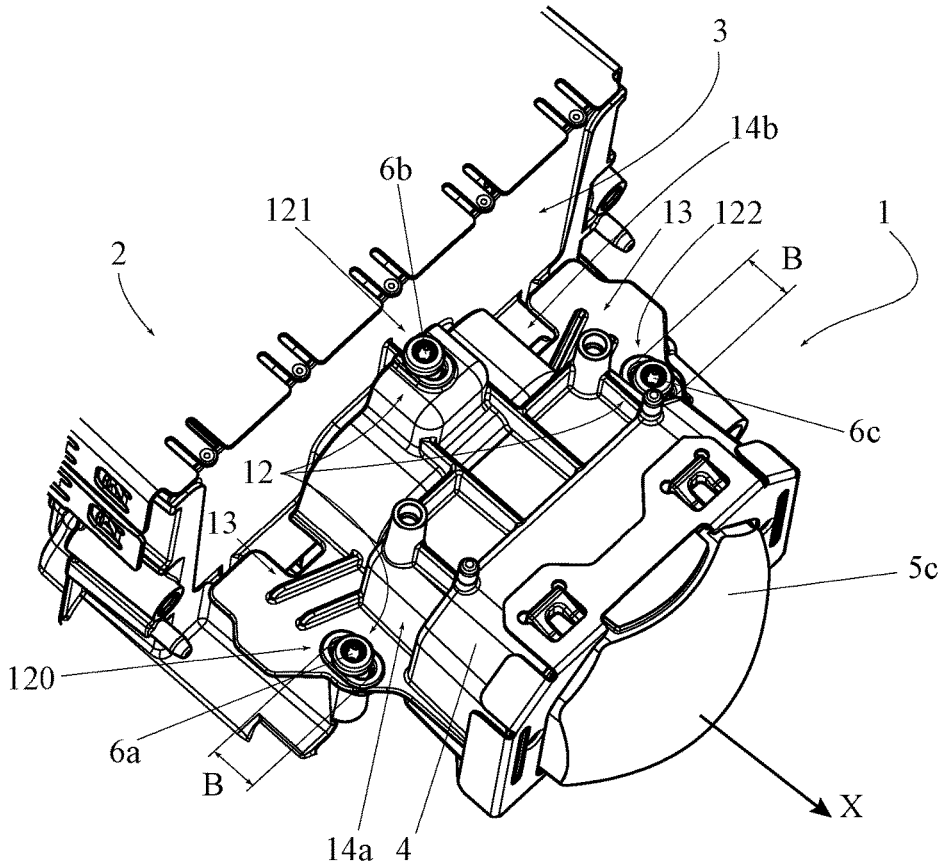
FIG. 4 shows the light module from FIG. 2, shown at an angle from above.

Furthermore, FIGS. 1, 2 and 4 indicate that the projection optics holder 4 has a fastening region 12, wherein the support structure 3 has a counter-region 33 corresponding to the fastening region 12. Therein, the range of movement B, fastening region 12 and the counter-region 33 correspond to each other in such a way that the projection optics holder 4 can be fastened to the support structure 3 in any position within the range of movement B in such a way that the fastening region 12 of the projection optics system 1 is at least partially fastened to the counter-region 33 of the support structure 3. In the light module shown, screws 6*a*, 6*b*, 6*c* were exemplarily used as fasteners. Gluing, riveting or welding is also conceivable. The fastening region 12 comprises three (elongated) through-openings 120, 121, 122. The counter-region 33 comprises three receiving means 330, 331, 332. Each receiving means 330, 331, 332 corresponds to a through-opening 120, 121, 122. Different receiving means 330, 331, 332 correspond to different through-openings 120, 121, 122. The fastening region 12 is arranged on the outer circumference of the projection optics holder 4. The through-openings 120, 121, 122 are distributed across the region 12, such that they offer a better hold of the projection optics system 1 on the support structure 3, in particular during the aforementioned adjusting by moving back and forth. FIGS. 1 and 4 taken together indicate that the through-openings 120, 121, 122 (and also the receiving means 330, 331, 332) are arranged in the approximate shape of a triangle both when viewed from above and from the front.

The through-openings 120, 121, 122 have a length corresponding to the range of movement B in the direction of the optical axis X, such that the range of movement B can be used to the greatest extent.

The receiving means 330, 331, 332 are designed as screw bosses. To fasten the projection optics system 1 or its projection optics holder 4, the (three) screws 6*a*, 6*b*, 6*c* are screwed through the through-openings 120, 121, 122 into the screw bosses 330, 331, 332.

The position in which the projection optics system 1 is fastened to the support structure is determined and selected depending on a desired quality of the light distribution, for example on a desired image scale.

Furthermore, FIGS. 1 to 4 show that the projection optics holder 4 has a handling area 13. The handling area 13 is on opposite sides 14*a*, 14*b* of the projection optics holder 4. It is particularly clearly indicated in FIGS. 3 and 4 that the handling area 13 protrudes from the sides 14*a*, 14*b* of the projection optics holder 4 and has approximately the shape of tabs that extend horizontally away from the projection optics holder 4.

The handling area 13 is provided for facilitating, in particular, automated handling or automated gripping of the projection optics system 1. The handling area 13 can, e.g., be detected by an industrial robot, such as an assembly robot performing precise longitudinal adjustments in the axial direction X, for example, to achieve a predefined image scale.

This makes it possible to improve the quality of the optical image in a light module having such a lens 1. In particular, the image sharpness can be improved, and imaging errors can be at least partially compensated for, which errors are caused by lens shape deviations, lens thickness tolerances, etc. This can be particularly advantageous in those light modules or lighting devices used for generating logo projections or different ground projection light distributions.

The elongated guides 31 each have a stop surface 31*a*, 31*b* at their ends, such that the respective guiding elements 10 can only be moved from a first end to a second end, which is opposite the first end, of the corresponding elongated guide 31. As a result, a longitudinal adjustment of the lens 1 relative to the support structure 3 in the axial direction X (direction of the optical axis) is limited to the predefined length L.

FIGS. 1 to 3 indicate that the elongated guides 31 are designed in the support structure 3 in arms 32 protruding in the direction of the projection optics system 1. The arms 32 protrude from a plane containing the opening 30 and extend parallel to the longitudinal direction X of the elongated guides 31 formed in the same. Exactly one elongated guide 31 is designed in each arm 32. The arms 32 are arranged to the side of the opening 30 and are connected by a connecting bar 34. The connecting bar 34 also protrudes from the support structure 3 in the direction of the optical axis X and partially closes the opening 30 (for example from above). The arms 32 and the connecting bar 34 together provide a support surface for the projection optics holder 4 of the projection optics system 1.

The projection optics holder 4 has two tabs 11 on the opposite sides 14*a*, 14*b*. The tabs 11 laterally protrude from the projection optics holder 4 and extend two-dimensionally in a horizontal direction. In addition, two of the three through-openings 120 and 122 are formed in the tabs 11. The handling area 13 is designed integrally with the tabs 11. In addition, the guiding elements 10 are designed on the protruding tabs 11. It is particularly evident in FIGS. 1 and 3 that each guiding element 10 is arranged at a distal end 11*a* of the corresponding tab 11.

Such an arrangement of the guiding elements 10 improves the handling when adjusting/positioning the lens 1 on the support structure 3 and thus reduces the risk of tilting/jamming the guiding elements 10 in the elongated guides 31. In addition, the "widest" possible arrangement of the guiding elements 10 relative to each other provides a stable support and guiding of the projection optics system 1.

The terms "top", "bottom", "vertical" and "horizontal" here refer to an expedient installation position commonly used in the art of the lighting device or the light module in a motor vehicle headlight installed in a motor vehicle, wherein, as already mentioned, the direction "downwards" is equal to the direction of gravity.

The object of the above description merely is to provide illustrative examples and to indicate further advantages and peculiarities of the present invention. The above description cannot therefore be interpreted as a restriction of the field of application of the invention, or the patent rights claimed in the claims. In the detailed description provided above, various features of the invention are summarized as examples in one or more embodiments for the purpose of streamlining the disclosure. This type of disclosure is not to be understood as reflecting the intention that the claimed invention requires more features than those expressly mentioned in each claim. Rather, as the following claims reflect, inventive aspects are present in fewer than all features of a single embodiment described above. (Thus, the following claims are hereby included in this detailed description, with each claim alone representing a separate preferred embodiment of the invention.)

In addition, although the description of the invention contains the description of one or more embodiments and certain variations and modifications, other variations and modifications, for example those within the skills and knowledge of persons skilled in the art, are within the scope of the invention according to the understanding of the present disclosure.

The reference numbers in the claims merely serve for a better understanding of the present invention and in no way constitute a limitation of the present invention.

The invention claimed is:

1. A lighting device of a motor vehicle headlamp comprising:

a projection optics system (1); and a light source unit (2), wherein the light source unit comprises a surface (20), wherein:

the light source unit (2) can generate a lighting pattern on the surface (20), wherein the lighting pattern which can be generated on the surface (20) can be projected in front of the lighting device in the form of a light distribution by means of the projection optics system (1), the light source unit (2) comprises a support structure (3), the support structure (3) has an opening (30), wherein the opening (30) is arranged and designed to match the surface (20) and the lighting pattern can be generated at least on one side (201) of the surface (20) facing the projection optics system (1), the projection optics system (1) has guiding elements (10) and the support structure (3) has elongated guides (31) corresponding to the guiding elements (10), wherein the guiding elements (10) are arranged in such a way that they can be guided in the elongated guides (31) along a longitudinal direction (X) of the elongated guides (31), the projection optics system (1) rests on the support structure (3), is movable along the longitudinal direction (X) and can be fastened to the support structure (3), and the projection optics system (1) is movable within a range of movement (B) defined by the length (L) of the elongated guides (31) and the projection optics system (1) has a fastening region (12) and the support structure (3) has a counter-region (33) corresponding to the fastening region (12), wherein the range of movement (B), fastening region (12) and the counter-region (33) correspond to each other in such a way that the projection optics system (1) can be fastened to the support structure (3) in any position within the range of movement (B) in such a way that the fastening region (12) of the projection optics system (1) is at least partially fastened to the counter-region (33) of the support structure (3).

2. The lighting device according to claim 1, wherein the projection optics system (1) comprises a projection optics holder (4) and at least one projection optics (5*a*, 5*b*, 5*c*), wherein the at least one projection optics (5*a*, 5*b*, 5*c*) is surrounded by the projection optics holder (4), wherein the guiding elements (10) are arranged on the projection optics holder (4).

3. The lighting device according to claim 2, wherein the projection optics holder (4) rests on the support structure (3), is movable along the longitudinal direction (X) and can be fastened to the support structure (3).

4. The lighting device according to claim 2, wherein the projection optics system (1) comprises two or more projection optics (5*a*, 5*b*, 5*c*).

5. The lighting device according to claim 4, wherein the projection optics system (1) has an achromatic and/or apochromatic effect.

6. The lighting device according to claim 1, wherein the fastening region (12) has at least two through-openings (120, 121, 122) and the counter-region (33) has at least two receiving means (330, 331, 332), wherein each receiving means (330, 331, 332) corresponds to a through-opening (120, 121, 122), wherein different receiving means (330, 331, 332) correspond to different through-openings (120, 121, 122), wherein the fastening region (12) can be fastened to the counter-region (33) by means of at least two fastening elements (6*a*, 6*b*, 6*c*) which can be accommodated in the through-openings (120, 121, 122) and in the receiving means (330, 331, 332).

7. The lighting device according to claim 6, wherein the through-openings (120, 121, 122) are elongated and extend in the direction of the optical axis (X).

8. The lighting device according to claim 6, wherein the fastening region (12) has three through-openings (120, 121, 122) and the counter-region (33) has three receiving means (330, 331, 332), wherein the fastening region (12) can be fastened to the counter-region (33) by three fastening elements (6*a*, 6*b*, 6*c*).

9. The lighting device according to claim 6, wherein the fastening elements are screws.

10. The lighting device according to claim 1, wherein the position is selected depending on a desired image scale or desired image sharpness.

11. The lighting device according to claim 1, wherein the projection optics system (1) has a handling area (13) which is designed on opposite sides (14*a*, 14*b*) of the projection optics system (1).

12. The lighting device according to claim 11, wherein the handling area (13) is designed on opposite sides (14*a*, 14*b*) of the projection optics holder (4).

13. The lighting device according to claim 11, wherein the handling area (13) is designed as tab-shaped elements protruding laterally from the projection optics system (1).

14. The lighting device according to claim 13, wherein the tab-shaped elements are tabs protruding laterally from the projection optics holder (4).

15. The lighting device according to claim 13, wherein the lateral tab-shaped elements extend from the projection optics holder (4) in a direction which is orthogonal to the optical axis (X).

16. The lighting device according to claim 15, wherein the lateral tab-shaped elements are tabs that extend horizontally from the projection optics holder (4).

17. The lighting device according to claim 1, wherein the elongated guides (31) each have a stop surface (31*a*, 31*b*) at their ends, such that the respective guiding elements (10) can only be moved from a first end to a second end, which is opposite the first end, of the elongated guide (31).

18. The lighting device according to claim 1, wherein the support structure (3) has arms (32), wherein the arms (32) of the support structure (3) protrude in the direction of the projection optics system (1), wherein the elongated guides (31) are designed in the arms (32), and the projection optics system (1) has protruding tabs (11), wherein the guiding elements (10) are arranged on the protruding tabs (11).

19. A motor vehicle headlight having at least one lighting device according to claim 1.

* * * * *